US005638963A

United States Patent [19]

Finnelly et al.

[11] Patent Number: 5,638,963

[45] Date of Patent: Jun. 17, 1997

[54] PRODUCT MANAGEMENT APPARATUS AND METHOD

[75] Inventors: Keith Finnelly, Issaquah; Ralph Ortiz, Bothell, both of Wash.

[73] Assignee: Laurel Graphics & Fabrication Company, Kent, Wash.

[21] Appl. No.: 412,959

[22] Filed: Mar. 29, 1995

[51] Int. Cl.[6] ..... A47F 5/00

[52] U.S. Cl. ..... 211/59.3

[58] Field of Search ..... 211/59.3, 59.2, 211/175, 153, 184; 312/35, 61, 71

[56] References Cited

U.S. PATENT DOCUMENTS

| | | | |
|---|---|---|---|
| 1,910,046 | 5/1933 | Pascoe | 211/49 D |
| 1,917,480 | 7/1933 | Widing . | |
| 2,098,844 | 11/1937 | Waxgiser | 211/49 D |
| 2,110,299 | 3/1938 | Hinkle | 211/59.3 |
| 2,460,396 | 2/1949 | Rifkin | 221/279 |
| 2,730,825 | 1/1956 | Wilds | 211/59.2 X |
| 3,083,067 | 3/1963 | Vos et al. | 312/71 |
| 3,104,137 | 9/1963 | Cohen | 312/71 |
| 3,162,259 | 12/1964 | Burroughs | 177/230 |
| 4,488,653 | 12/1984 | Belokin | 248/206.5 X |
| 4,550,916 | 11/1985 | Ortiz | 273/239 |
| 4,762,235 | 8/1988 | Howard et al. | 211/59.3 |
| 4,836,390 | 6/1989 | Polvere | 211/59.3 |
| 4,907,706 | 3/1990 | Henderson | 211/94 X |
| 4,907,707 | 3/1990 | Crum | 211/59.3 |
| 5,111,942 | 5/1992 | Bernardin | 211/59.3 |
| 5,199,584 | 4/1993 | Fowler et al. | 211/59.2 X |
| 5,413,229 | 5/1995 | Zuberbuhler et al. | 211/59.3 |
| 5,450,969 | 9/1995 | Johnson et al. | 211/59.3 |
| 5,469,976 | 11/1995 | Burchell | 211/59.3 |

*Primary Examiner*—Alvin C. Chin-Shue
*Assistant Examiner*—Sarah L. Purol
*Attorney, Agent, or Firm*—Bogle & Gates P.L.L.C.

[57] ABSTRACT

A product display system provides for ease of product facing in conjunction with or as a part of store shelving. The product support surface is coupled to a moveable push member and/or a moveable pull stick. When products are to be faced, the pull stick is drawn forward carrying any push member forward and repositioning a row of products preferably adjacent to the forward edge of the shelf.

28 Claims, 6 Drawing Sheets

FIG. 3
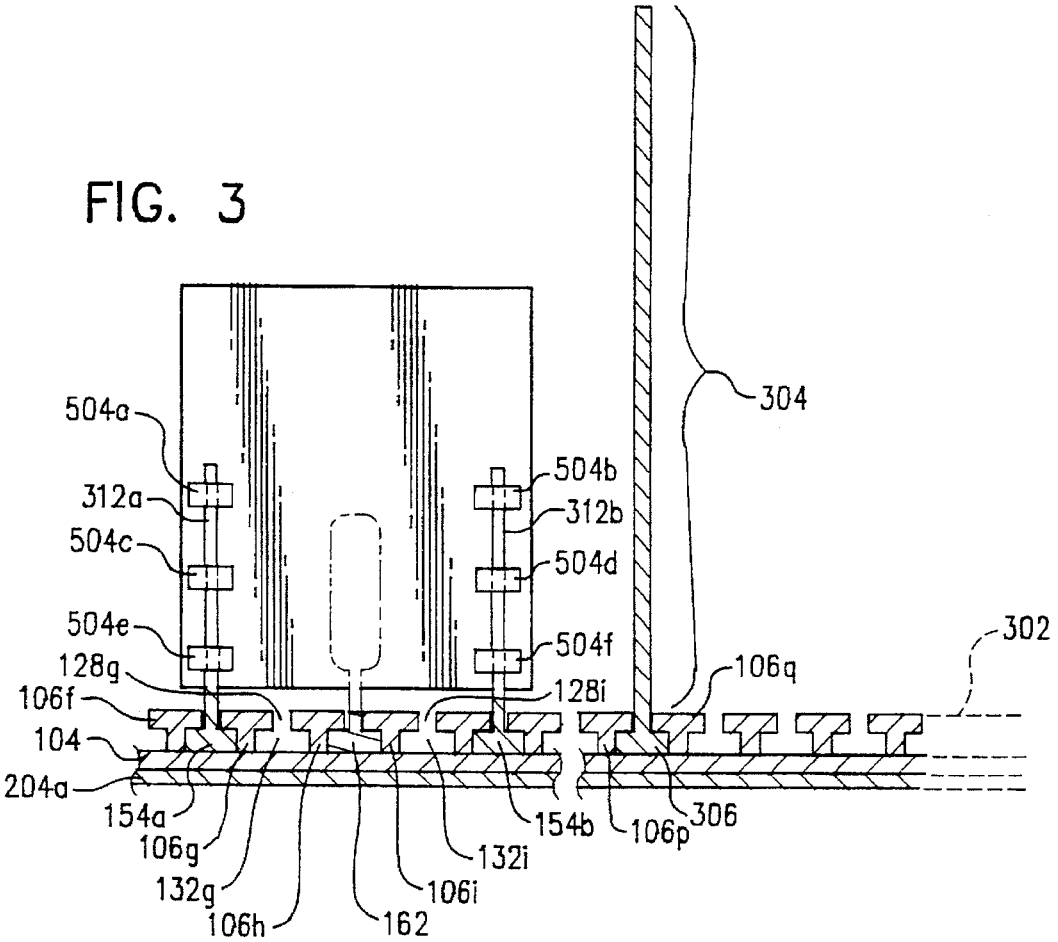
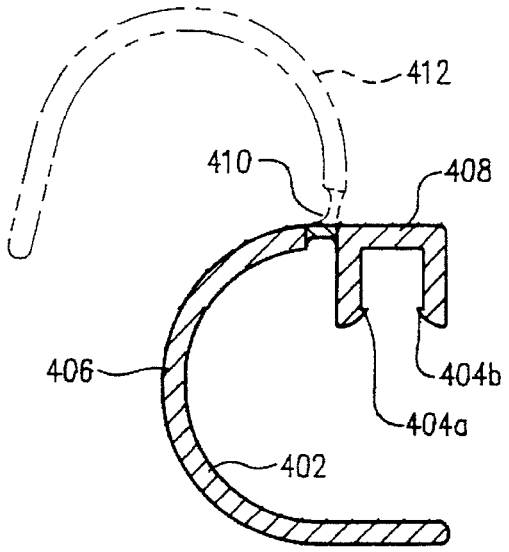
FIG. 4
FIG. 5
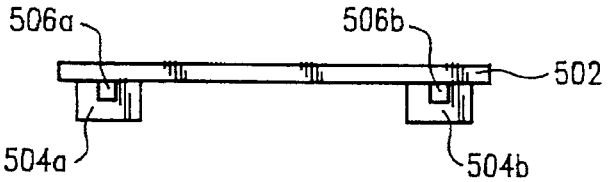

PRODUCT MANAGEMENT APPARATUS AND METHOD

The present invention relates to management, storage and display of products for sale and, in particular, to a method and apparatus for properly positioning a plurality of products on a shelf.

BACKGROUND INFORMATION

It is common in retail situations to display goods or products for sale on shelving or other horizontal surfaces. Commonly, consumers will select desired products, typically removing the products closest to the front edge of the shelf. As products are removed in this fashion, the retailer will often reposition the remaining products towards the edge of the shelf (process known as "facing" the shelf) in order to provide a more pleasing appearance and avoid displacing or knocking over adjacent products if a consumer must reach towards the back of the shelf to obtain the desired product (particularly when product is relatively narrow).

The process of facing the shelf is labor intensive and costly for a retailer. Typically, when a shelf is faced, a clerk will reach above a row of products, towards the rear of the shelf, grasping one or more of the more rearwardly-placed products and pulling the products forward. This can require an awkward posture, particularly for very high or very low shelves, and also requires that there be sufficient "headroom" between the top of the products and the bottom of the shelf above (if any), thus wasting potential display area.

In addition to the problem of facing shelves, a retailer must often deal with the problem of products which have been displaced or knocked over by consumers. This problem is particularly acute in the case of products which are relatively tall and narrow, such as typical deodorant products. It has been found that such tall, narrow products are very often displaced from their desired row configuration or knocked over in the process &consumer selection, leaving a disarrayed appearance, creating difficulty in locating and selecting desired products and generally depressing sales. Returning the products to an orderly display following such displacement or knocking over is also labor intensive. This problem, particularly with tall, narrow products, can be partially ameliorated by packaging products in a container having a larger "footprint," so as to be less prone to displacement or knocking over. However, many manufacturers, especially in recent years, have been reluctant to provide such packaging for tall, narrow products because of the cost involved. In some cases, retailers attempt to reduce the magnitude of this problem by reducing the depth of a row of products on a shelf. This, however, means that less of the product can be kept in open-shelf stock, more must be maintained in the back room or warehouse stock (involving higher space costs), and the shelves must be re-stocked more often (involving higher labor costs) and on-shelf stock will be more often fully depleted (depressing sales).

Accordingly, it would be advantageous to provide a system which facilitates facing of shelves, maximizes display area, assists in maintaining products in desired rows, and resists displacement or knocking over of products and avoids movement or falling of products off the front edge of the shelf, at least during facing, while permitting relatively deep rows of products to be maintained on shelves.

SUMMARY OF THE INVENTION

According to the present invention, a plurality of products on a shelf are faced by pulling forward a pushing device placed behind a row of products. Preferably, the products are maintained in rows by guides or walls. In one embodiment, the pulling device is pulled forward by a pull stick which engages the movable push device or plate. Preferably, the walls or guides can be moved to any of a plurality of locations to accommodate many product widths. Preferably, the pull stick and plate can be positioned in a variety of locations to accommodate different product sizes. In one embodiment, the push device or plate has feet connected through slots in a base plate to channels so that the plate can move forward and backward as the feet move through the channels. A channel is also provided, below the top surface of the base, to accommodate a pull stick. A portion of the pull stick extends upward through a slot in the base plate to contact a rear surface of the push device. When the user wishes to face a shelf, the user grasps the forward end of the pull stick and pulls forward. The pull stick extension contacts the back of the plate and pulls the plate forward which, in turn, pushes the row of products in a forward direction.

BRIEF DESCRIPTION OF THE DRAWINGS

FIG. 3 is a cross-sectional view taken along line 3—3 of FIG. 1;

FIG. 4 is a cross-sectional view of a cover member according to an embodiment of the present invention;

FIG. 5 is a top plan view of a push plate, according to an embodiment of the present invention;

DETAILED DESCRIPTION OF THE PREFERRED EMBODIMENT

Figure 1:
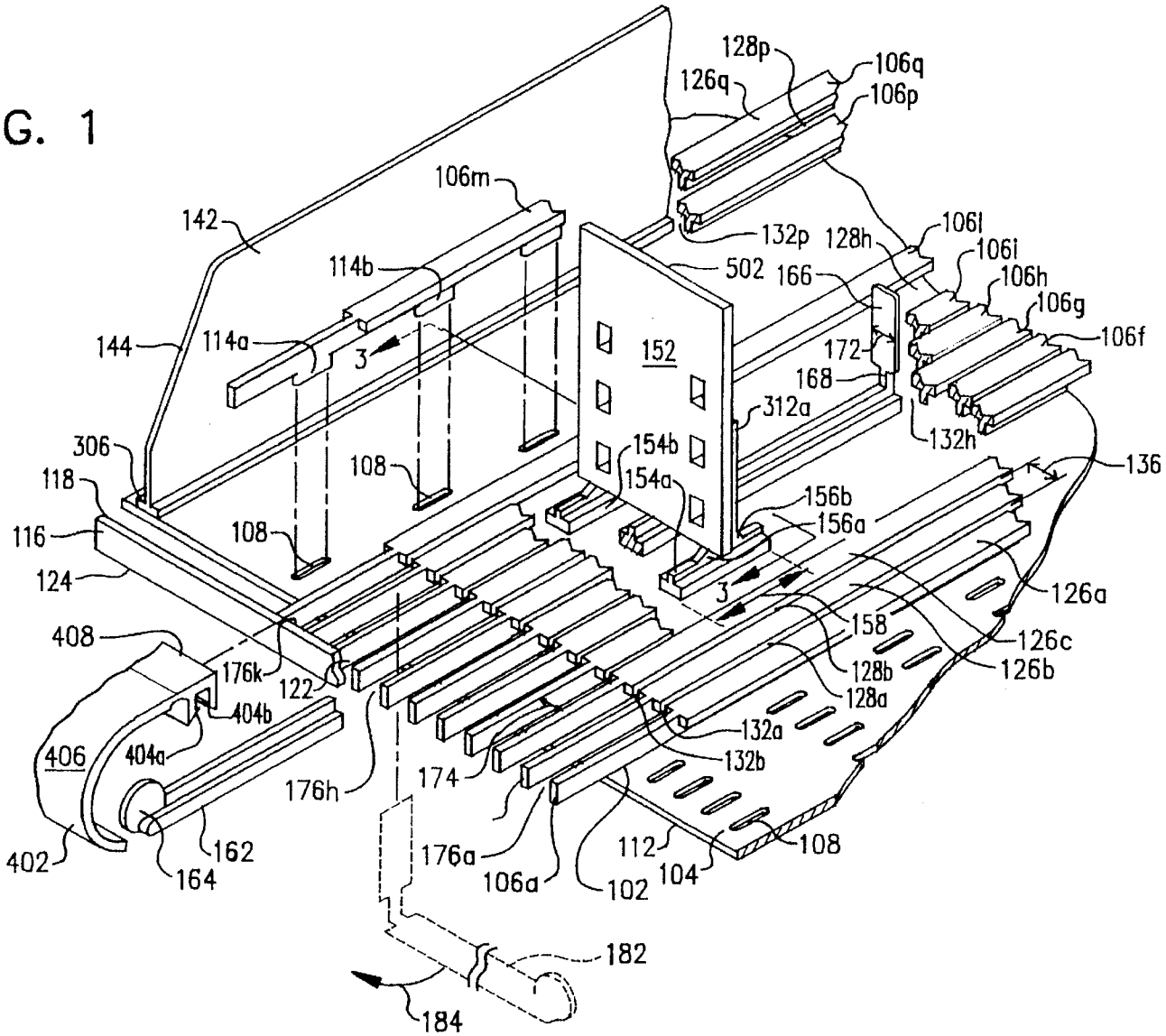
FIG. 1 is a perspective view, partially broken away and partially exploded, of apparatus according to an embodiment of the present invention.

In the embodiment depicted in FIG. 1, a base unit 102 is made up of a bottom plate 104 and a plurality of T-channel wails 106*a*, 106*b*, 106*p*, 106*q*.

Figure 2:
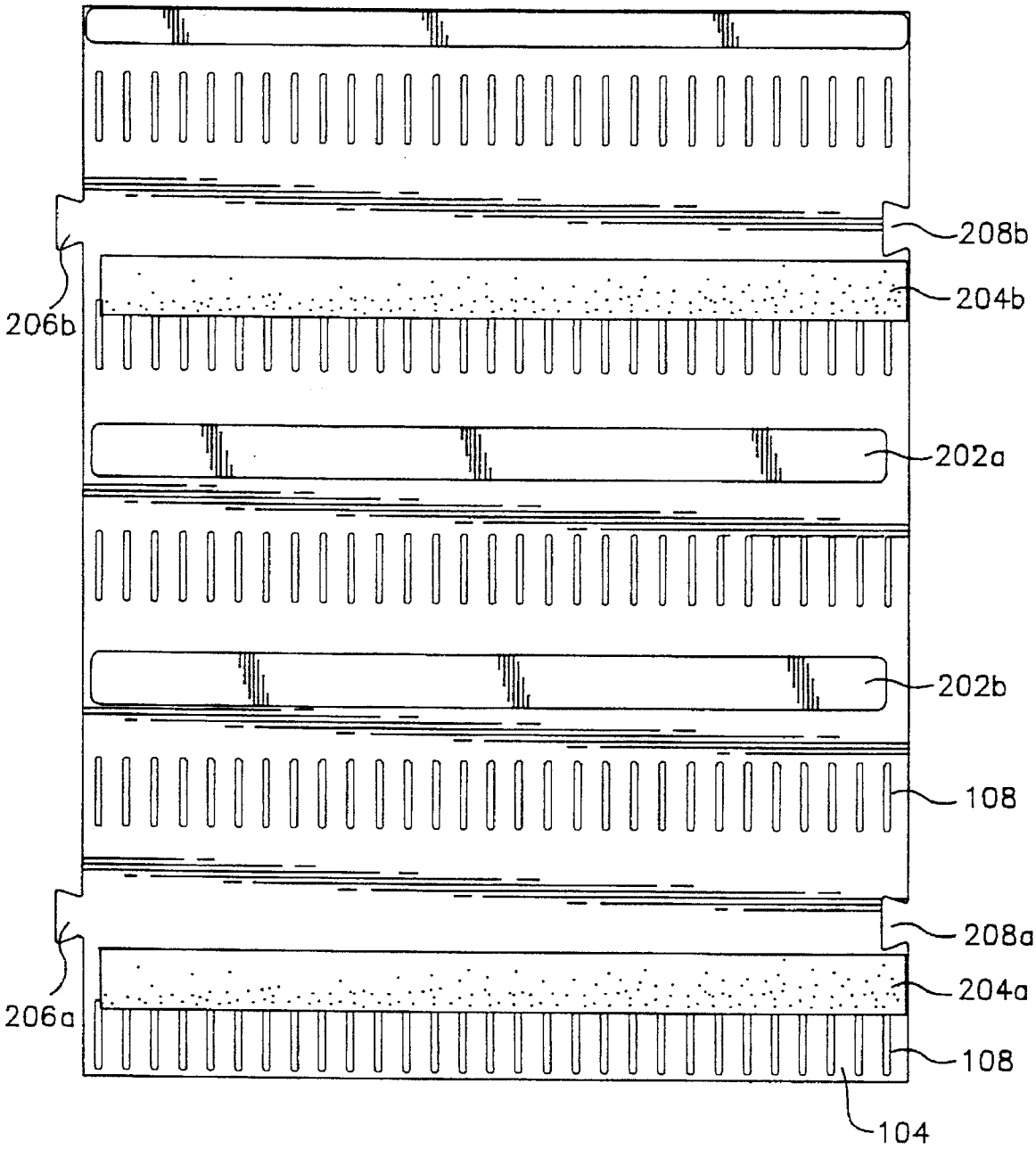
FIG. 2 is a bottom plan view of a base plate member according to an embodiment of the present invention.

FIG. 2 depicts the bottom surface of the base plate 104 according to an embodiment of the present invention. A plurality of holes 108 are used for attaching the channel walls (e.g., as described more thoroughly below). Slightly raised ridges or feet 202*a*, 202*b* can be provided on the bottom surface for both support and rigidifying purposes. In one embodiment magnetic strips 204*a*, 204*b* are attached to the bottom surface (e.g., by an adhesive), for help in securing the base plate in a desired location on a store shelf(which is often metallic). Preferably the apparatus is positioned on the shelf without fixedly attaching to the shelf (e.g., without using screws or bolts) to facilitate ease of rearranging. Tabs 206*a*, 206*b* and slots 208*a*, 208*b* can be provided for aligning and securing the plurality of adjacent base plates for placing side-by-side on a length of shelving.

The base plate 104 can be made of a number of materials, including plastic, metal, fiberglass, ceramic, resin, reinforced or composite materials. In one embodiment the base plate 104 is made from a thermoplastic polymer such as polypropylene. To accommodate the use as described below, it is important to fashion the base from a material which can be formed in a smooth surface with substantially little or no "flash" so that the relatively-moving parts can move in a smooth, low friction manner.

A cover 402 may fit over the front of the apparatus, such as by clipping, using resilient detects 404*a*, 404*b* over the top edge 118 of the lip 116. Preferably, the front portion 406 is movably coupled to the clip portion 408 by, e.g., a hinge such as an integral or living hinge 410, so that the front portion 406 may be raised or pivoted about the hinge 410 to an open configuration (shown in phantom in FIG. 4) to expose the front ends of the pull sticks for use as described more fully below. The cover 406 in the closed position provides a pleasing appearance, protects and covers the ends of the pull sticks and avoids unauthorized or mischievous use of the device. The cover 406 may be made of a number of materials, including plastics, metals, fiberglass, resins, ceramics, reinforced and composite materials. In one embodiment, the cover 402 is formed of polyvinyl chloride (PVC). In some cases, the living hinge 410 is formed of a different composition and is co-extruded with the remainder of the cover.

The channel walls 106*a*, 106*b* have a substantially T-shaped cross section in the major portion of their length, as best seen in FIG. 3. In the embodiment depicted in FIG. 1, the forward portion of the channel walls is an extension of the "stem" of the T-shaped portion, thus forming substantially vertical walls. In the embodiment of FIG. 1, the vertical wall portion of the channel walls extends forward past the front edge 112 of the base plate 104. In the depicted embodiment the channel walls 106 have tabs 114*a*, 114*b* extending downwardly from the bottom edges thereof for fitting in the holes 108 of the base plate 104. The channel walls can be held in place with respect to the base plate 104 by a number of methods, including welding, such as ultrasound welding, adhesives, latching, and the like. Where possible, it is preferred to form the channel walls 106 and base plate 109 integrally, in a single process, rather than forming separately and welding in order to reduce costs. A lip 116 is attached to the front edges of the channel numbers 106, slightly offset therefrom so that the top edge 118, is higher than the top edges of the channel members 106 and the lower edges 122 of the channel members are lower than the lower edge 124 of the lip 116. Preferably, the lip 116 has a length 632 slightly less than the width 634 of the base plate 104. The upper surfaces 126*a*–126*q* of the channel walls 106*a*–106*q* are substantially coplanar to define a substantially flat bearing surface defining a plane 302 on which the products rest. Preferably, the plane or surface 302 on which the products move (as described below) is substantially smooth, at least in the region that may contact products, and is without protrudances, bumps, rivets or similar irregularities. The upper surfaces 126*a*–126*q* are spaced slightly apart to define a plurality of slots 128*a*–128*p*.

A plurality of inverted-T channels 132*a*–132*p* are defined between the channel walls 106*a*–106*q*. Thus, the channel cross sections define first and second planar regions 303*a*, 303*b*, meeting at an angle, such as about 90°. Preferably, all of the channels 132 are substantially the same size and shape. In this way, any channel can accommodate any of the various items which may be inserted or couple to the channels, including a pull stick, a wall or guide, and a push plate, as described more thoroughly below. Preferably the channel walls extend the entire length between extreme positions of push member and/or pull stick to avoid the potential for lateral movement or "fishtailing." Preferably, the spacing 136 between adjacent channels is relatively small, such as less than half the distance between sidewalls (when positioned for an average product) and preferably about 0.5 inches (about 10 millimeters), so that relatively fine adjustments of widths can be achieved. Thus the pull stick is also relatively narrow. By making the channels able to accommodate different items, the apparatus can be reconfigured easily to accommodate different sizes of products.

The channel walls 106 can be formed of a number of materials, including plastic, metal, fiberglass, resin, reinforced or composite materials. In one embodiment, the channel walls 106 are formed from the same material used to form the base plate 104.

To assist in guiding products towards the forward edge and, when desired, maintaining the products in a single row, guide walls or rails may be coupled to the base member. In the depicted embodiment, a guide wall 142 has an upper substantially planar portion 304 FIG. 3, and a lower portion 306 with an inverted-T cross-section configured to fit within an inverted T-shaped channel 132. Engagement of the foot 306 with a channel 132 maintains the wall in the desired vertical configuration. The walls may be positioned in any of a plurality of channels to adjust the defined row width for accommodating different product widths. The wall 142 may be made of a number of materials, including plastics, metals, fiberglass, ceramics, resins, reinforced and composite materials. In one embodiment, the wall or divider 142 is formed of styrene. Preferably, the walls, at least for the length which is adjacent products, are substantially smooth and without protrudances, bumps, rivets or similar irregularities. In one embodiment the wall is substantially transparent to improve the appearance and make it easier for purchasers to find desired products when viewing the shelf obliquely. A sloped portion 144 near the front edge may be provided to make it easier for a purchaser to grasp a product near the front of the shelf.

In the depicted embodiment, the push device 152 comprises a plate 502 coupled to feet 154*a*, 154*b*. The plate 502 can be a number of heights. In one embodiment, the plate 502 is about four inches (about 10 centimeters) in height. In one embodiment, the width of the plate is approximately 2.25 inches (about 6 centimeters). The feet 154*a*, 154*b* have a substantially inverted-T cross-sectional shape corresponding to the shape of the channels 132. The feet also include upwardly-extending arms 312*a*, 312*b*, preferably supported by ramps 156*a*, 156*b*. The feet 154*a*, 154*b* have a length 158 which is relatively short (such as about 2 inches, about 5 centimeters) compared with the length 602 of the channel 132 so that the feet and attached plate are movable between a first position 604*a* distal or spaced from the front edge or lip 116, and a second position 604*b* substantially near or adjacent to the front edge or lip 116.

In one embodiment the plate 502 is coupled to the arms 312*a*, 312*b* using U-shaped brackets 504*a*–504*f* defining holes 506*a*, 506*b* for receiving the arms 312*a*, 312*b*. A number of materials can be used to construct the pushing device. In one embodiment, the plate portion 502 is formed of materials similar to that used to form the base plate 104. In one embodiment the feet 154*a*, 154*b* are formed from a relatively durable thermoplastic resin such as polycarbonate.

The pull stick 162 has a relatively elongated shape having a portion with an inverted-T cross-sectional shape configured within and move longitudinally within a channel 132. Preferably, a handle 164 is formed on the forward end of the pull stick 162. A paddle 166 is coupled to the rear end of the pull stick via a stalk extending through the slot 128*h* corresponding to the channel 132*h*. The pull stick 162 is movable between a first position 612*a* with the paddle 166 adjacent to the rear end 614 of the apparatus, and a second position 612*b* with the paddle 166 near or adjacent to the front edge or lip 116.

The pull stick 162 could be made of a number of materials, including plastic, metal, fiberglass, resins, ceramics, reinforced and composite materials. In one embodiment, the pull stick 162 is made of polycarbonate.

In use, the base unit is formed by attaching and preferably welding the channels wails 106 to the base plate 104 to form the channeled structure generally as depicted in FIG. 1. Walls 142 are positioned at the desired spacing, e.g. to accommodate a single row of products, by inserting the foot portion 306 into a channel 132 through the rear edge 614 of the device. Preferably, both left and right walls 142, 143 are positioned.

In one embodiment, the paddle 166 has a width 172 greater than the spacing 174 in the expanded-channel portion 616. In this embodiment, the pull stick 162 is inserted into the device in the following manner. The pull stick 164 is positioned below the front region openings 176 defined between the front edge 112 of the base plate 104 and the lip 116. The pull stick is initially aligned substantially parallel with the base plate frontage 112 as depicted on 78 in phantom in FIG. 1, 182. The paddle 166 is then inserted through the open region 176*h* corresponding to the channel 132*h* which the pull stick 162 is to be inserted into. Once the paddle 166 is elevated above the level of the base plate 104, the pull stick is rotated 184 90° to the position 162 depicted in FIG. 1 and the pull stick 162 is then pushed toward the rear edge 164 inserting the pull stick in the desired channel 132*h* (angling the pull stick somewhat downward if necessary).

Figure 8A:
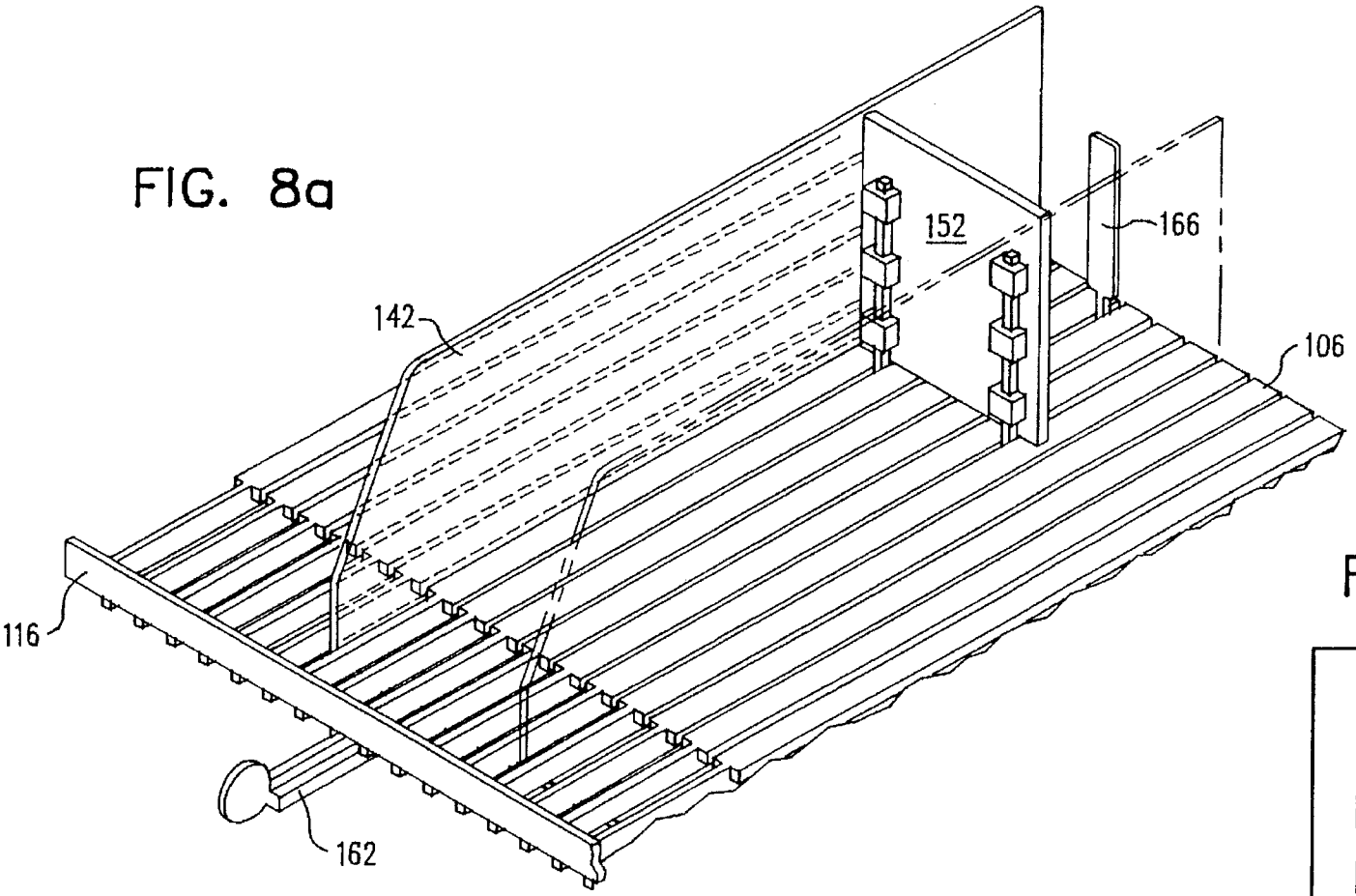
FIG. 8A is a perspective view of an embodiment of the present invention.
Figure 8B:
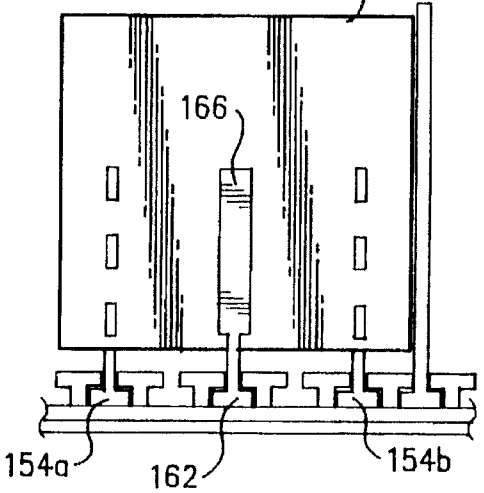
FIG. 8B is a partial rear elevational view according to an embodiment of the present invention.

The push device 152 is coupled to a channel by inserting the feet 154*a*, 154*b* in the wide-channel region 616 near the front of the device and moving towards the rear 614 to engage the feet 154*a*, 154*b* and the inverted-T portion of the channels 132 (possibly angling the push device 162 slightly downward to accommodate insertion). Preferably, the push stick 162 is inserted prior to insertion of the plate 152 so that the paddle 166 is more rearward than the plate 502. In the embodiment of FIGS. 8A and 8B, the push device 152 is inserted so that the brackets 504 face forward, rather than rearward.

Figure 6:
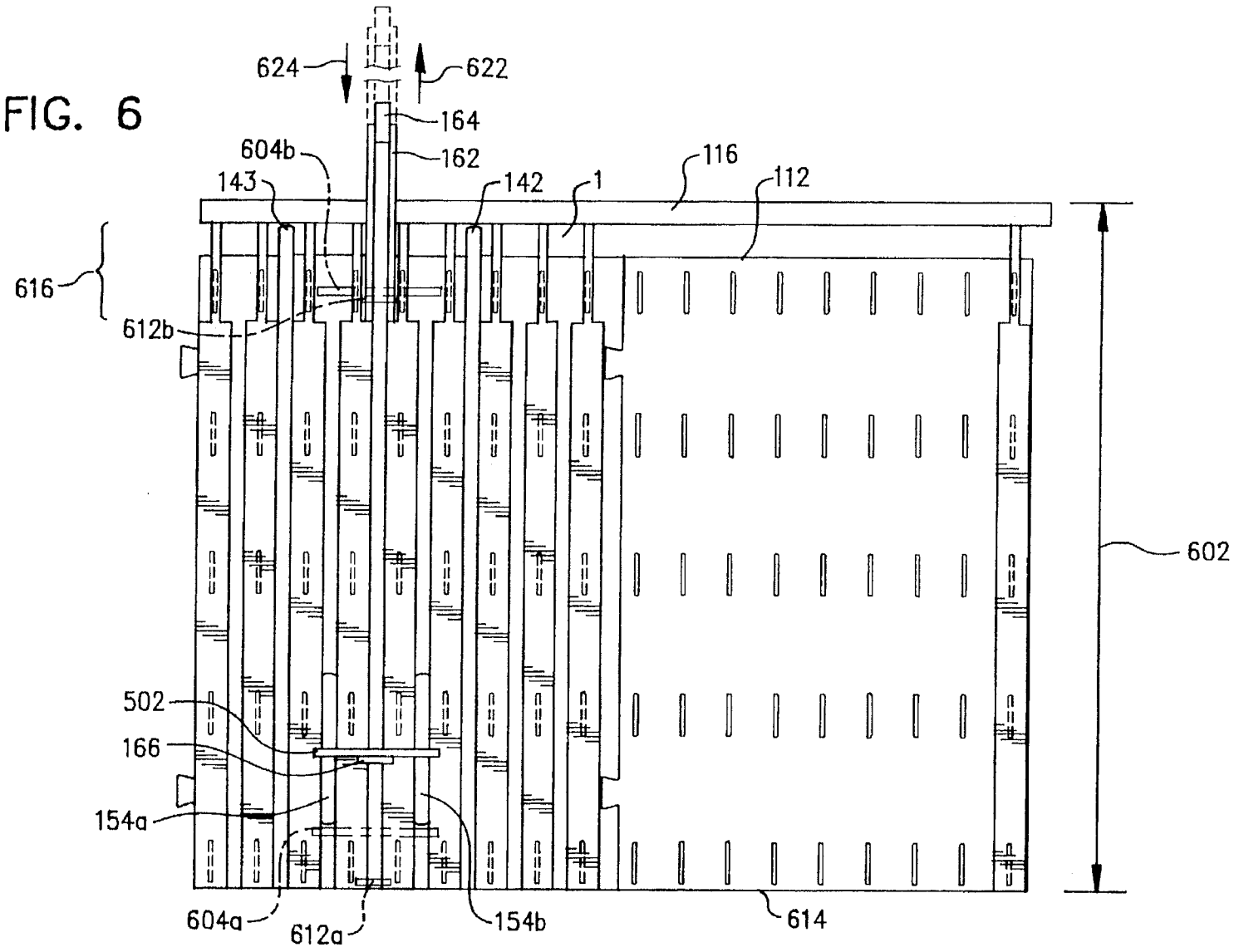
FIG. 6 is a top plan view of an apparatus according to an embodiment of the present invention.

The device configured on this fashion is then placed on a store shelf, held in place partially by the magnetic strips 204. If desired, two or more such units can be aligned and coupled using tabs and slots 206, 208, e.g. as depicted in FIG. 6. The products to be displayed are positioned so as to rest on the surface 302 defined by the channel walls and forward of the push device 152. During normal display, the push stick 164 will be placed as far rearwardly as possible 612*a* so that the push stick and handle 164 are covered by cover 402. When it is desired to face the shelf, the cover 402 is lifted to the open position 4012. A user grasps the handle 164 for the pull stick 162 which underlies the row of products to be faced. The user pulls forward 622 on the pull stick 162 causing the paddle 166 to contact the rear surface of the push device plate 502. Further pulling 622 on the pull stick 162 causes the paddle 166 to pull the push device 152 towards the lip 116. Eventually, the push device 152 will contact the products which are in front of the push device 152 pushing them towards the lip 116. The products are maintained in the desired row configuration by the walls 142, 143 during this movement. When the front-most product in the row reaches the desired location and/or contacts the lip 116 and/or the open cover 402, the products is preferably prevented from moving forward beyond the front edge of the shelf. Thus, in this embodiment, the lip 116, cover 402 or other front edge stop device is maintained substantially adjacent the front edge and does not move substantially outward beyond the front edge during use of the pull stick. The user pushes the pull stick 624 back towards the rear edge 614 to place it in the rest position 612*a*. The push device 152, being, in the depicted embodiment, independent of the pull stick 162 will remain in position behind the rear-most product thus helping to avoid knock-over of products. After facing all the rows of products desired for a given module, the cover 402 is returned to the closed position as depicted in FIG. 4.

Figure 7:
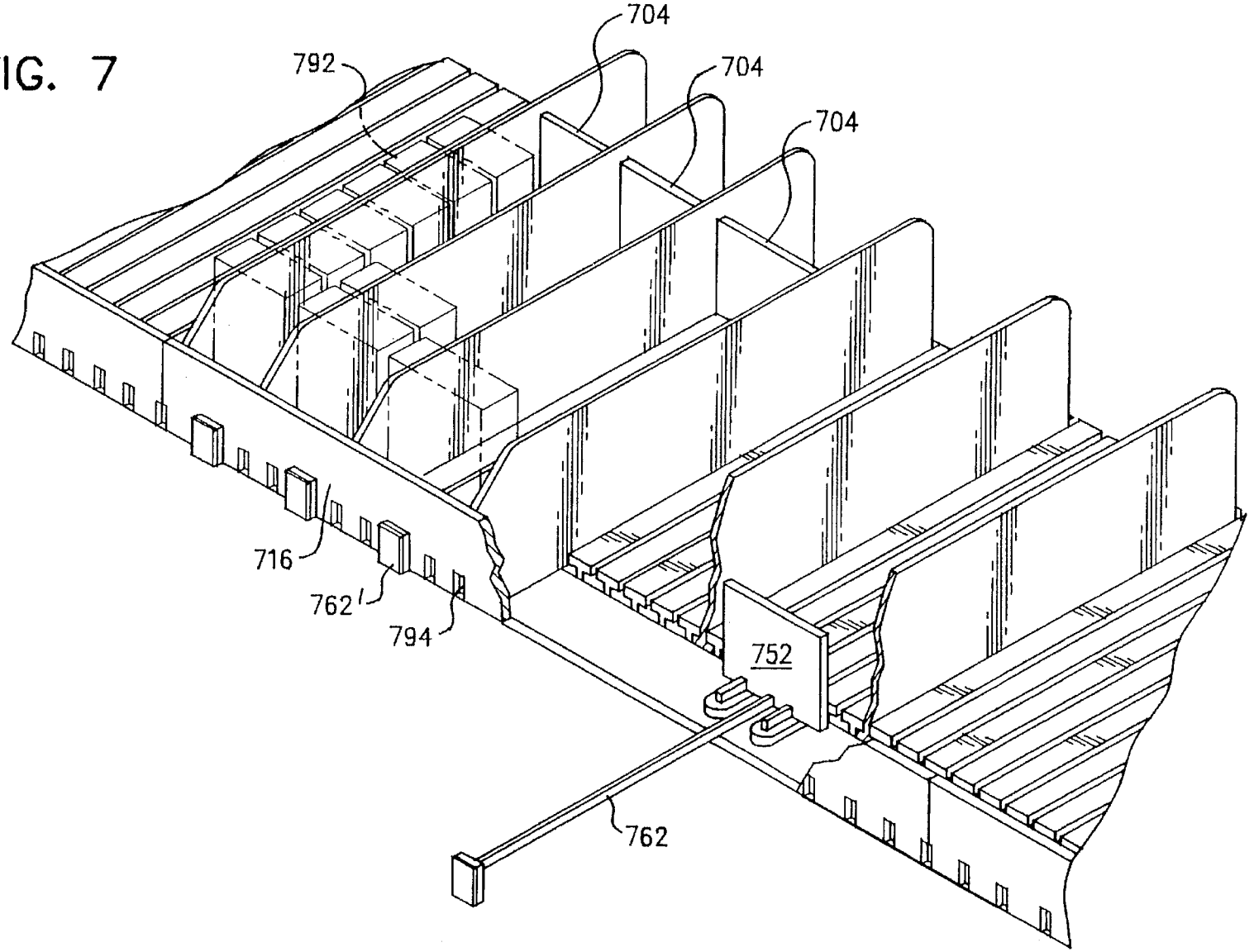
FIG. 7 is a perspective view, partially broken away, of an embodiment of the present invention.

FIG. 7 depicts an embodiment of the invention in which the pull stick 762 is attached to the push device 752, rather than being independent thereof. Thus, this embodiment when the pull stick 762 is moved back to its resting position 762' following facing the shelf, the push devices will be returned to a rearward position 704, rather than remaining immediately behind a row of product 792. In the embodiment of FIG. 7, the pull stick 762 extends through holes 794 in the lip 716, rather than extending underneath the bottom edge 124 as in the embodiment in FIG. 1.

In light of the above description, a number of advantages of the present invention can be seen. The present invention provides a durable, low-cost, adjustable way of maintaining products near a front edge of a shelf. The device avoids the need for extensive head room and thus maximizes display areas. The device resists displacement or knocking over of products particularly tall narrow products.

A number of variations and modifications of the invention can also be used. The pushing device 152 can use a number of items for contacting and pushing products in addition to a plate, such as a bar, a mesh, etc. The pushing device can have a number of widths or can be provided with an adjustable width. The back plate 502 can be provided with vertical or horizontal scores so that the user can break or snap off portions to reduce the width or height. In the described embodiment, the walls or dividers were configured to be inserted from the rear edge of the device. In order avoid the necessity for gaining access to the rear edge of the device in order to adjust the location of the dividers, a device can be configured to provide access through the front edge or to provide periodic slots in the channel top surfaces corresponding to foot tabs on the wall feet for inserting the walls from above. The base plate can be provided in a plurality of different widths 602, preferably in width bits corresponding to the depths of various standard types of shelving (such as 12 inch, 14 inch, 16 inch, and 24 inch shelving). As depicted, the guides or side panels 142 are substantially identical regardless of whether they are provided on the left side or the right side of a product, thus reducing mold costs, inventory, cost, etc. Although a depicted embodiment shows a pull stick positioned between push device feet, other configurations are possible. The pull stick could be configured along side products or above products. The pull stick can be positioned within and/or coupled to one or more sidewalls. A pull stick can be configured to couple to more than one push member. Although in the depicted embodiment it is contemplated that the pull stick will reside in a channel when not in use, the device can be configured such that the pull stick (or a portion thereof) may be easily removable and insertable, e.g., to avoid unauthorized use, wherein, when shelves are to be faced, store personnel will insert a pull stick (or a portion thereof), face the shelf, then remove the pull stick (or portion thereof). Although the depicted apparatus is shown as separate from the shelving and which can be placed on shelving, it is possible to integrate the apparatus as part of the shelving. The apparatus can be provided without a member to stop or limit forward movement, such as without a lip 116. It is possible to provide for limiting forward movement only when the pull stick is being used, such as by using the opened cover 402 to limit such movement, and thus eliminate any lip or ridge at the front of the shelving device during normal use. It is possible to use other mechanisms for manually moving the pushing mechanism 152 forward, such as levers, gears. (e.g. worm gears), cables and pulleys and the like. It is also possible to provide for a mechanism for driving the plate 152 forward at desired times such as using a stepper motor, a linear motor, a spring mechanism and like. Although it is possible to provide a device which asserts constant pressure of the push device 152 on the row of products (e.g. by making the push device 152 spring-biased in a forward direction, or gravity-biased). It is preferable, for at least some uses, to avoid such biasing, in order to avoid any clamping type of action or feel that might be experienced by the user upon removing the product from the shelving. If desired, the row of products can be telemetered, e.g. using a photo cell near the front edge of the device. e.g. for providing automatic notification when a row needs to be faced or re-stocked. Although inverted T-shaped channels are depicted and provide for security in holding the various components, other shapes can also be used such as an L-shape, an I-shape, a V-shape, a slot-shape, a round-shape and the like. It is possible to use some aspects of the invention without using other aspects. For example, it is possible to use the pull stick and paddle for facing shelves, without using a push device 152. It is possible to use the apparatus for facing shelves without providing or using side walls or guides 142. Although the depicted embodiments provide a single size and shape of channel, it is possible to use different size channels for different purposes, e.g. to use one size or shape for accommodating the pull stick and another size or shape for holding the side walls 142 and/or the push device 152. It is possible to place the channels for holding the various devices on various planes or levels. For example, a channel for a pull stick could be placed underneath the channels for the push member legs, e.g. so that the pull stick could act directly on the push member legs, rather than on the push member plate or body. Although in the embodiment of FIG. 1, the push member is depicted as being formed in separate pieces (plate and legs) which are coupled together, it is possible to use a push member which is formed in an integral or unitary manner. Although some or all of the components can be made by injection molding, other fabrications methods could also be used for some or all parts, such as extrusion.

Although the invention has been described by way of a preferred embodiment and certain variations and modifications, other variations and modifications can also be used, the invention being defined by the following claims.

What is claimed is:

1. Apparatus for moving items to position the items at the front edge of a shelf, comprising:

a substantially flat surface for supporting said items, with at least one channel formed below said surface;

a push member movable with respect to said surface between a first push member location spaced from said front edge and a second push member location substantially adjacent said front edge; and a pull member having a first surface for contacting said push member and a longitudinal portion, said pull member movable between first and second positions, said pull member, when in said first position, having said first surface substantially adjacent said first push member location and said longitudinal portion extending through at least a portion of said channel, said pull member, when in said second position having said first surface substantially adjacent said second location; wherein said pull member is configured to permit movement in a direction from said second position toward said first position without contacting said push member.

2. Apparatus as claimed in claim 1 wherein said flat surface includes at least one track extending between said first location and said second location and said push member includes at least one foot insertable in said track which guides movement of said push member between said first and second push member locations.

3. Apparatus as claimed in claim 2 wherein said one channel and said track are substantially identical in cross-sectional shape.

4. Apparatus, as claimed in claim 1, further comprising at least one wall member extending substantially between said first and second locations.

5. Apparatus, as claimed in claim 4, wherein said surface includes at least one groove and wherein said wall member includes a foot portion said foot portion being configured to fit in said groove to retain said wall member in a desired location.

6. Apparatus as claimed in claim 5 wherein said groove and said channel are substantially identical in shape.

7. Apparatus, as claimed in claim 1, wherein said channel defines a slot in said surface and said pull member includes at least a first portion extending through said slot above said surface.

8. Apparatus, as claimed in claim 1, wherein at least a first portion of said channel has a cross-sectional shape with edges defining two substantially planar portions meeting at an angle.

9. Apparatus, as claimed in claim 8, wherein said angle is about 90 degrees.

10. Apparatus, as claimed in claim 9, wherein said channel first portion has an inverted T shape.

11. Apparatus, as claimed in claim 9, wherein said channel first portion has an L shape.

12. Apparatus, as claimed in claim 1, wherein said channel has an expanded region.

13. Apparatus, as claimed in claim 12, wherein said expanded region has a shape to accommodate insertion, into said channel, of at least a portion of at least one of said push member and said pull member.

14. Apparatus as claimed in claim 1, further comprising a cover moveable between a first configuration at least partially covering a portion of said pull member and a second configuration exposing said portion of said pull member.

15. Apparatus as claimed in claim 1, wherein said push member is substantially independent of said pull member.

16. Apparatus as claimed in claim 1, wherein said pull member is attached to said push member.

17. Apparatus as claimed in claim 1, further comprising a magnetic region coupled to said flat surface for holding said apparatus on a metallic shelf.

18. Apparatus as claimed in claim 1, further comprising at least a first interlocking shape on an edge of said flat surface for coupling said substantially flat surface to a second substantially flat surface.

19. Apparatus as claimed in claim 1, wherein said substantially flat surface is formed of polypropylene.

20. Apparatus as claimed in claim 1, wherein said pull member comprises polycarbonate.

21. Apparatus as claimed in claim 4, wherein said wall member comprises styrene.

22. Apparatus as claimed in claim 1, wherein said push member is substantially unbiased.

23. Apparatus as claimed in claim 1, further comprising a shelf member, wherein said substantially flat surface is formed integrally with said shelf member.

24. Apparatus for moving items to position the items at the front edge of shelf comprising:

substantially flat means for supporting said items;

at least a first channel means coupled to said substantially flat means;

push means for contacting a product resting on said substantially flat surface means;

said push means moveable between a first location spaced from said front edge and a second location substantially adjacent said front edge;

means for moving said push means between said first location and said second location;

wherein at least a portion of said means for moving is located in a first location, extending at least a first distance outward from said front edge when said means for moving moves said push means in a direction towards said second location; and means for guiding movement of said means for moving toward a second location, without contacting said push means wherein said means for moving, in said second location, does not extend outward said first distance from said front edge.

25. A method for moving items to position the items at the front edge of a shelf comprising:

providing a push member;

providing a support device for said push member to permit said push member to move between a first location spaced from said front edge and a second location substantially adjacent said front edge;

contacting said push member with an elongated pull member;

pulling forward on said pull member to move said push member toward said front edge of said shelf, pushing said items which are forward of said push member toward said front edge of said shelf; and pushing on said pull member to position the major part of said pull member beneath said support device, in the absence of contact between said pull member and said push member.

26. Apparatus, as claimed in claim 1 further comprising at least a second channel substantially coplanar with said at least one channel.

27. Apparatus, as claimed in claim 2, wherein said track is spaced from said channel.

28. Apparatus, as claimed in claim 1, further comprising a lip which extends upward above the said substantially flat surface adjacent said front edge at least when said pull member is moved between said first and second positions.

* * * * *